US009548538B2

(12) United States Patent
Bengtsson et al.

(10) Patent No.: US 9,548,538 B2
(45) Date of Patent: Jan. 17, 2017

(54) ANTENNA ARRANGEMENT AND DEVICE

(71) Applicant: Sony Corporation, Tokyo (JP)

(72) Inventors: Erik Lennart Bengtsson, Eslöv (SE); Ying Zhinong, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 51 days.

(21) Appl. No.: 14/360,091

(22) PCT Filed: Jun. 20, 2013

(86) PCT No.: PCT/IB2013/001290

§ 371 (c)(1),
(2) Date: May 22, 2014

(87) PCT Pub. No.: WO2014/203018

PCT Pub. Date: Dec. 24, 2014

(65) Prior Publication Data

US 2015/0155634 A1 Jun. 4, 2015

(51) Int. Cl.

| | |
|---|---|
| ***H01Q 9/00*** | (2006.01) |
| ***H01Q 9/04*** | (2006.01) |
| ***H01Q 19/00*** | (2006.01) |
| *H01Q 5/378* | (2015.01) |

(52) U.S. Cl.

CPC ..... *H01Q 9/0442* (2013.01); *H01Q 9/0421* (2013.01); *H01Q 19/005* (2013.01); *H01Q 5/378* (2015.01)

(58) Field of Classification Search

CPC ..... H01Q 9/0442; H01Q 19/005

USPC ..... 343/702, 745

See application file for complete search history.

(56) References Cited

U.S. PATENT DOCUMENTS

| | | | | |
|---|---|---|---|---|
| 2005/0190110 | A1 | 9/2005 | Taromaru et al. | |
| 2007/0285321 | A1 * | 12/2007 | Chung | H01Q 1/38 343/702 |
| 2009/0128428 | A1 * | 5/2009 | Ishizuka | H01Q 1/243 343/702 |
| 2010/0328164 | A1 * | 12/2010 | Huynh | H01Q 1/243 343/702 |
| 2011/0148723 | A1 * | 6/2011 | Bengtsson | H01Q 9/0442 343/745 |

(Continued)

FOREIGN PATENT DOCUMENTS

| | | | | |
|---|---|---|---|---|
| EP | 0 400 872 | A1 | 12/1990 | |
| EP | 2 048 739 | A1 | 4/2009 | |
| SE | EP 1962375 | A1 * | 8/2008 | H01Q 1/243 |

OTHER PUBLICATIONS

International Search Report and Written Opinion dated Feb. 26, 2014 issued in corresponding PCT application No. PCT/IB2013/001290, 10 pages.

*Primary Examiner* — Dieu H Duong
(74) *Attorney, Agent, or Firm* — Tucker Ellis LLP

(57) ABSTRACT

Antenna arrangement (10) comprising at least one parasitic element (12), a feed element (14), and at least one-tuning circuitry (16). The at least one-parasitic element (12) comprises a first connection (18) connected to ground (20), and a second connection (22) connected to said at least one-tuning circuitry (16), and is galvanically separated from said feed element (14) and electromagnetically coupled to said feed element (14).

12 Claims, 2 Drawing Sheets

(56) References Cited

U.S. PATENT DOCUMENTS

2011/0221636 A1* 9/2011 Chiu ..... H01Q 9/0421
343/700 MS

* cited by examiner

ANTENNA ARRANGEMENT AND DEVICE

The present invention concerns an antenna arrangement and a device comprising such an antenna arrangement.

BACKGROUND OF THE INVENTION

An antenna is a transducer designed to transmit and/or receive radio, television, microwave, telephone and radar signals, i.e. an antenna converts electrical currents of a particular frequency into electromagnetic waves and vice versa. Physically, an antenna is an arrangement of on or more electrical conductors that is arranged to generate a radiating electromagnetic field in response to an applied alternating voltage and the associated alternating electric current, or that can be placed in an electromagnetic field so that the field will induce an alternating current in the antenna and a voltage between its terminals.

Portable wireless communication electronic devices, such as mobile phones, typically include an antenna that is connected to electrically conducting tracks or contacts on a punted circuit board (PCB) by soldering or welding. Manufacturers of such electronic devices are under constant pressure to reduce the physical size, weight and cost of the devices and improve their electrical performance. This low cost requirement dictates that the electronic device and its antenna should be simple and inexpensive to manufacture and assemble.

A further challenge facing manufacturers is to provide electronic devices with a compact, high gain, multi-band antenna to cover a wider frequency range demanded by new bands in the Long Term Evolution (LTE) standard.

SUMMARY OF THE INVENTION

An object of the present invention is to provide an improved antenna arrangement.

This object is achieved by an antenna arrangement comprising at least one parasitic element, a feed element (i.e. a medium for conveying signal energy from a signal source to the antenna of the antenna arrangement), and at least one tuning circuitry. The at least one parasitic element comprises a first connection connected to ground, i.e. a permanent ground connection and a second connection connected to the at least one tuning circuitry. The et least one parasitic element is galvanically separated from the feed element (i.e. the parasitic element is not galvanically connected to the feed element) and electromagnetically coupled to said feed element, for example capacitively coupled to said feed element, via a capacitor for example. According to an embodiment of the invention the capacitor is a lumped capacitor.

The electrical length for at least one of the resonances of the at least one parasitic element can be changed, i.e. electrically extended and/or electrically shortened using the tuning circuitry of the antenna arrangement (without changing the physical length of the parasitic element). The electrical length of the at least one parasitic element may be hanged by adding (i.e. loading) or removing capacitances and inductances to/from the at least one parasitic element to impede/facilitate the propagation of a signal therethrough. The antenna arrangement may be tuned from 700-660 MHz, which corresponds approximately to a 20% relative change in the electrical length of the parasitic element.

At least one of the resonances of the antenna arrangement can be tuned down in a way which ensures good matching. The antenna arrangement is easy to tune to a desired frequency band and thereby operate in a desired low band (700-960 MHz) or high band (above 960 MHz) and it is simple and inexpensive to manufacture.

According to another embodiment of the invention the at least one tuning circuitry comprises a switch, such as a SP3T switch, terminated with a plurality of different resistances, capacitances and/or inductances.

According to a further embodiment of the invention the at least one tuning circuitry comprises at least one tunable capacitor.

The resonances of the antenna arrangement according to the present invention may be arranged to cover any combination of at least two frequency bands of interest simultaneously (i.e. 3rd Generation Partnership Project (3GPP) bands for carrier aggregation). The antenna arrangement is capable of covering all (or most) of the frequency bands >1 GHz passively and will then be able to operate simultaneously (aggregate the bands) on them. A limitation occurs in low band where one resonance covers band 8 (880-960 MHz) passively and the tunable resonance needs to be tuned to cover B17, B13, B20 or B5 (704-894 MHz). B17, B13, B20 and B5 are consequently difficult to aggregate with each other while any other combination should be possible.

According to an embodiment of the invention the antenna arrangement comprises an additional parasitic element (or stub) which is arranged to act as a filter to obtain an additional resonance (or radiating mode). This additional resonance may be in the high frequency range (i.e. above 960 MHz).

The present invention also concerns a device that comprises an antenna arrangement according to any of the embodiments of the invention. According to an embodiment of the invention the device may be a portable electronic device. According to another embodiment of the invention the device comprises or constitutes a mobile telephone, such as a clamshell telephone or a stick-type telephone. The present invention may however concern any portable or non-portable device such as a media player, Personal Communications System (PCS) terminal, Personal Data Assistant (PDA), laptop computer, palmtop receiver, camera, television, radar or any appliance that includes a transducer designed to transmit and/or receive electromagnetic waves, for example radio, television, microwave, telephone and/or radar signals. The antenna arrangement according to the present invention is however intended for use particularly, but not exclusively for high frequency radio equipment.

BRIEF DESCRIPTION OF THE DRAWINGS

The present invention will hereinafter be further explained by means of non-limiting examples with reference to the appended figures where.

It should be noted that the drawings have not necessarily been drawn to scale and that the dimensions of certain features may have been exaggerated for the sake of clarity.

DETAILED DESCRIPTION OF EMBODIMENTS

Figure 1:
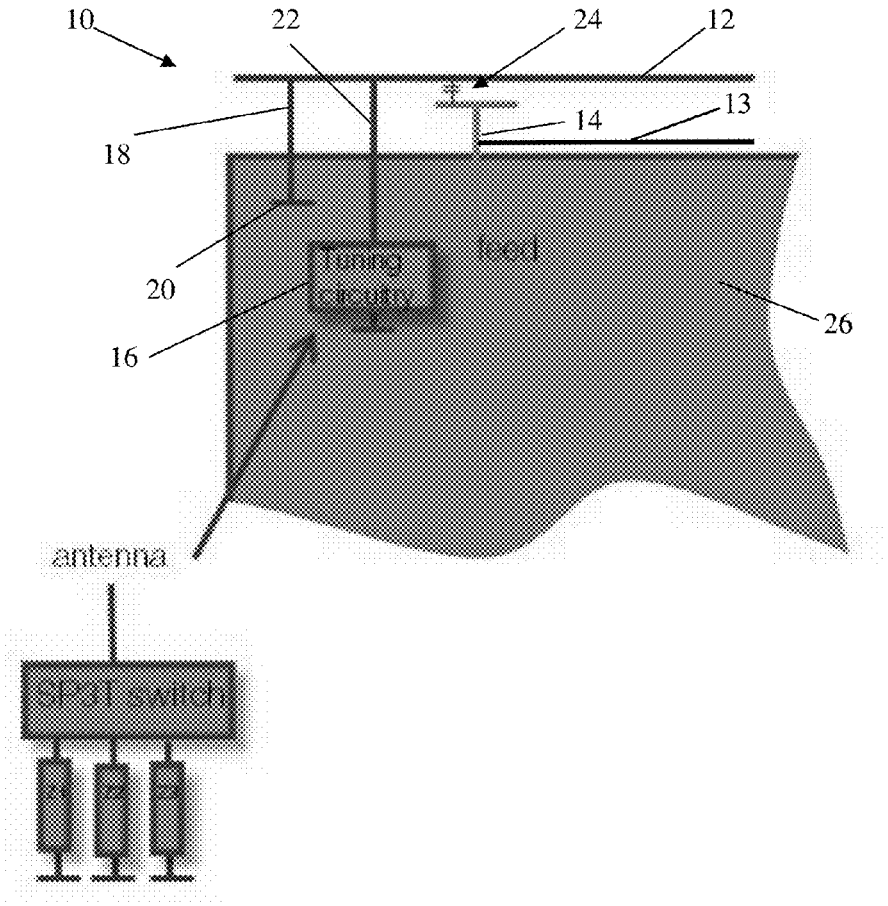
FIG. 1 schematically shows an antenna arrangement according to an embodiment of the invention.

FIG. 1 shows an antenna arrangement 10 according to an embodiment of the invention. The antenna arrangement 10 comprises a parasitic element 12, a feed element 14 for feeding at least one feed antenna element 13 and tuning circuitry 16. The parasitic element 12 comprises a first connection 18 connected to ground 20, i.e. a permanent ground connection, and a second connection 22 connected to the tuning circuitry 16. The parasitic element 12 is galvanically separated from the feed element 14 (i.e. the parasitic element 12 is not galvanically connected to the feed element 14) and is capacitively coupled to said feed element, via a capacitor 24, such as a lumped capacitor for example. Alternatively, the parasitic element 12 may be inductively coupled to the feed element 14.

The parasitic element 12 is a conductive element which is added to a feed antenna of the antenna arrangement to enable operation at a different frequency. It is parasitically coupled to the feed antenna and resonates at a different frequency than the feed antenna. The parasitic element 12 acts as a passive resonator scattering the radio waves from the nearby driving element. The tuning circuitry 16 of the antenna arrangement is used to change the electrical length of the parasitic element 12 so that wide band coverage is obtained. The configuration also enables aggregated carriers supports low band (LB) and any desired higher band and some LB combinations.

The antenna arrangement 10 and at least one feed antenna element, may be mounted on a printed circuit board (PCB) or carrier 26, or some other part of a device. The PCB or carrier 26 may be any flexible or non-flexible, planar or non-planar, substantially non-electrically-conductive substrate. The antenna pattern 10 may be either a self carrying metal structure or a flexfilm (or similar) on a non conductive carrier that is used to physically support the antenna arrangement 10. A PCB may also comprise at least one microchip or other electronic component, and/or may electrically conned components supported thereon and/or connected thereto using conductive pathways etched/printed/engraved or otherwise provided thereon. A carrier may be any dielectric substrate having a relative dielectric constant ($\in_r$) greater than one and may for example comprise a PTFR (polytetrafluoroethylene)/fibreglass composite or any other suitable dielectric material having a relative dielectric constant ($\in_r$) up to twenty or more An antenna arrangement 10 may be provided on and/or beside a PCB or earner 26, or a device using a lithographic technique for example. The components of the antenna arrangement 10 may for example be provided by depositing/bonding continuous electrically conducting layers, of metal for example, onto a PCB or carrier, In the embodiment illustrated in FIG. 1, the antenna arrangement 10 is located at the corner of a PCB or a carrier 20. An antenna arrangement 10 may however be located at any position on a PCB or a carrier 26 or in any part of a device.

According to an embodiment of the invention the tuning circuitry 16 comprises a switch, such as a SP3T switch as shown in the illustrated embodiment, terminated with a plurality of different impedances Z1, Z2 and Z3. Alternatively, or additionally the tuning circuitry 16 may comprise a plurality of resistances and/capacitances and/or inductances, or at least one tunable capacitor. For example, the tuning circuitry 16 may be used to lengthen the electrical length for one or more of the radiating modes of the parasitic element by switching in inductive coils in series with the parasitic element 12.

Figure 2:
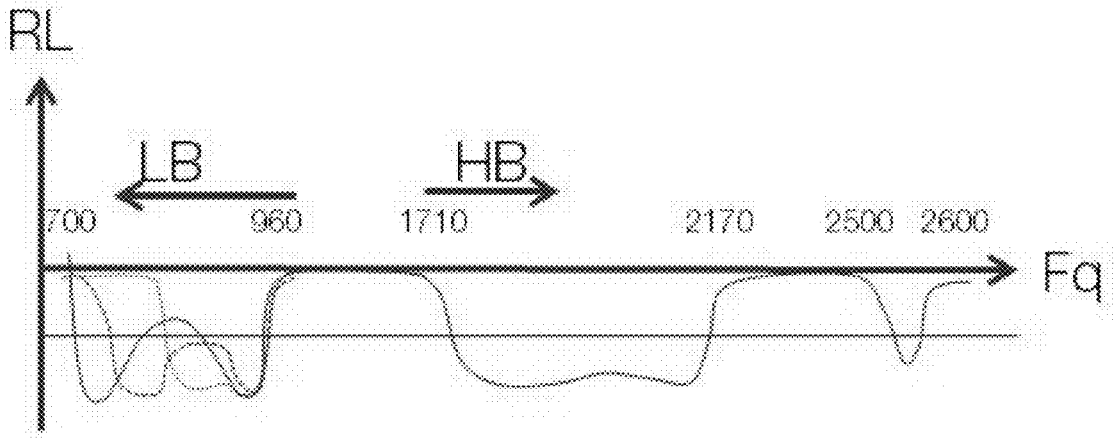
FIG. 2 shows frequency bands covered by an antenna arrangement according to an embodiment of the invention.

FIG. 2 shows frequency bands covered by an antenna arrangement 10 according to an embodiment of the invention. The antenna arrangement 10 may namely be tuned to a desired frequency hand and thereby operate in a desired low band (LB) (700-960 MHz) or high band (HB) (above 960 MHz).

The antenna arrangement 10 according to an embodiment of the invention may comprise a capacitive feed antenna that has a wide bandwidth in low band. Such an antenna arrangement will be relatively small and will cover frequency bands B20, B5 and B8 (790-960 MHz) passively. The antenna will also be able to cover conventional high bands from about 1700-2220 MHz and B7 (2500-2700 MHz). By changing the electrical length for at least one of the resonating modes of the parasitic element 12 using the tuning circuitry the antenna arrangement may be arranged to cover the relevant frequency bands defined by the 3rd Generation Partnership Project (3GPP), or any combination of LB and/or HB frequencies.

Figure 3:
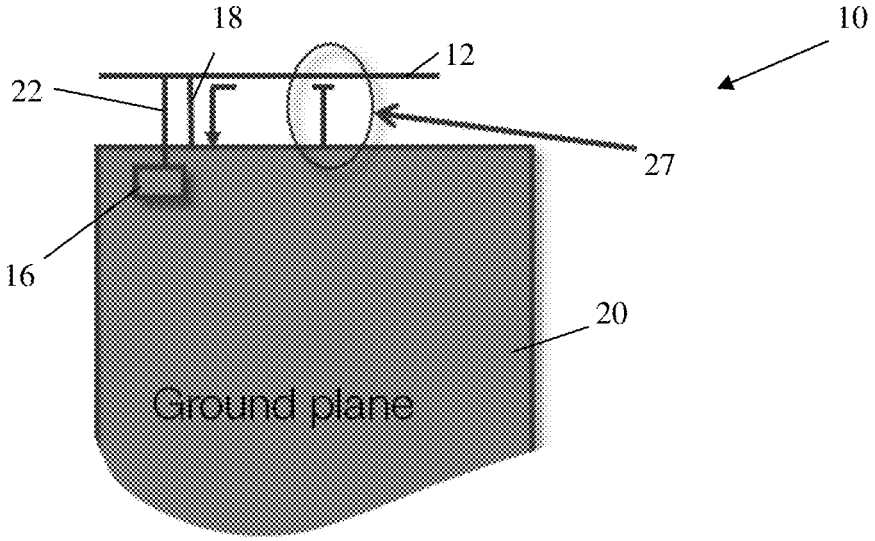
FIG. 3 shows an antenna arrangement according to another embodiment of the invention, and FIG. 4 schematically shows a device according to an embodiment of the invention.

FIG. 3 shows an antenna arrangement 10 according to another embodiment of the invention which is an additional parasitic element (or stub) 27 which is arranged to act as a filter to obtain an additional resonance (or radiating mode). This additional resonance may be in the high frequency range (i.e. above 960 MHz).

Figure 4:
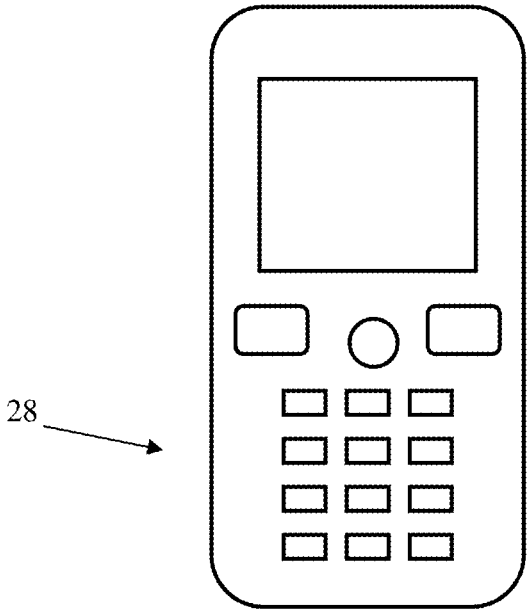

FIG. 4 shows a device 28 according to an embodiment of the invention, namely a portable stick-type telephone. The device 28 comprises an antenna arrangement 10 such as the one illustrated in FIG. 1.

It should be noted that when the antenna pattern 10 according to any of the embodiments of the invention is included in a small portable radio communication device 28, such as a mobile phone, it only partly contributes to the transmission or reception of the radio waves transmitted or received by the device 28. Other large, electrically conductive components of the device 28, such as its chassis, its battery or a printed circuit board also influence the transmission and/or reception of radio signals. The antenna arrangement 10 is capacitively and/or inductively coupled to these mass blocks in such a way that the complete antenna (i.e. the antenna arrangement 10 and the mass blocks) is provided with the desired impedance.

Further modifications of the invention within the scope of the claims would be apparent to a skilled person. It should for example be rioted that the antenna arrangement 10 described in this document, which is physically supported by a PCB or carrier 26, could of course be replaced with a self-supporting antenna arrangement 10 that does not require a PCB or carrier 26. A self-supporting antenna arrangement is therefore also considered to lie within the scope of the appended claims.

The invention claimed is:

1. An antenna arrangement for tuning of a low band in a range of 700-960 MHz, the antenna arrangement comprising:

at least one parasitic element through which a low band tunable signal propagates, a feed element, and a single tuning circuitry, wherein said at least one parasitic element comprises a first connection connected to ground, and a second connection connected to said tuning circuitry, and wherein said at least one parasitic element is galvanically separated from said feed element and electromagnetically coupled to said feed element, and wherein the single tuning circuitry comprises a switch terminated with a plurality of different impedances, the switch and impedances operable to selectively impede or facilitate the propagation of the low band tunable signal through the parasitic element.

2. The antenna arrangement according to claim 1, wherein said at least one parasitic element is capacitively coupled to said feed element via a capacitor.

3. The antenna arrangement according to claim 1, wherein the single tuning circuitry comprises at least one tunable capacitor.

4. The antenna arrangement according to claim 1, wherein the at least one parasitic element is associated with a first resonance mode and the antenna arrangement further comprises:

an additional parasitic element configured to act as a filter to obtain an additional resonance for the antenna arrangement.

5. The antenna arrangement according to claim 4, wherein said additional resonance is in a high frequency range above 960 MHz.

6. A device comprising an antenna arrangement according to claim 1.

7. The device according to claim 6, wherein the device comprises a portable electronic device.

8. The device according to claim 6, wherein the device comprises a mobile telephone.

9. The antenna arrangement according to claim 1, wherein the parasitic element is a conductive element that is added to a feed antenna element, the feed antenna element feed by the feed element, the parasitic element enabling operation of the feed antenna element at different frequencies.

10. The antenna arrangement according to claim 9, wherein the parasitic element is parasitically coupled to the feed antenna element and resonates at a different frequency than the feed antenna.

11. The antenna arrangement according to claim 10, wherein the parasitic element acts as a passive resonator and scatters radio waves from the feed antenna element.

12. The antenna arrangement according to claim 11, wherein resonance of the parasitic element is tunable and is changed by changing an electrical length of the parasitic element with the tuning circuitry.

* * * * *